US005602633A

United States Patent [19]

Yoshida et al.

[11] Patent Number: 5,602,633

[45] Date of Patent: Feb. 11, 1997

[54] IMAGE FORMING APPARATUS WITH LOW OZONE GENERATION AND IMPROVED IMAGE QUALITY

[75] Inventors: Minoru Yoshida, Tokyo; Toshihiro Kasai; Masashi Takahashi, both of Yokohama, all of Japan

[73] Assignee: Kabushiki Kaisha Toshiba, Kawasaki, Japan

[21] Appl. No.: 527,722

[22] Filed: Sep. 13, 1995

[30] Foreign Application Priority Data

Sep. 19, 1994 [JP] Japan ..... 6-222826

[51] Int. Cl.[6] ..... G03G 15/14

[52] U.S. Cl. ..... 399/244; 399/305; 399/311

[58] Field of Search ..... 355/271, 274, 355/317, 326 R, 327, 312

[56] References Cited

U.S. PATENT DOCUMENTS 5,243,396 9/1993 Castelli et al. ..... 355/327

5,488,399 1/1996 Mitomi et al. ..... 355/327 X

*Primary Examiner*—William J. Royer

*Attorney, Agent, or Firm*—Foley & Lardner

[57] ABSTRACT

A color printer includes a conveyer belt for conveying a paper sheet to make the sheet pass through a plurality of photoconductive drums. A suction roller for sucking a supplied paper sheet on the conveyer belt is provided on the upstream side of the photoconductive drums in the conveying direction of the paper sheet, such that the suction roller is in rolling contact with the belt. Transfer chargers are provided at positions opposing the photoconductive drums, respectively, with the conveyer belt situated between the drums and the transfer chargers. The running distance L1 (mm) of the conveyer belt from a sheet peeling position corresponding to the photoconductive drum at the rearmost position to a suction position where the suction roller is provided, the volume resistance $\rho$ ($\Omega$·cm) of the belt, and the relative dielectric constant $\epsilon$ of the belt are set so as to satisfy a relation of $L1/V \geqq (\epsilon \cdot \epsilon_0 \cdot \rho) \times 7$.

14 Claims, 7 Drawing Sheets

IMAGE FORMING APPARATUS WITH LOW OZONE GENERATION AND IMPROVED IMAGE QUALITY

BACKGROUND OF THE INVENTION

1. Field of the Invention

The present invention relates to an image forming apparatus such as a color copying machine, a color printer or the like, and particularly, to an image forming apparatus which forms images on a plurality of image carriers, and sequentially transfers these images onto a transfer material such as a paper sheet, to obtain a hard copy.

2. Description of the Related Art

Conventionally, in many color image forming apparatuses of an electrophotography method, yellow, magenta, cyan, and black toner images are sequentially formed for every one turn of a photoconductive drum as an image carrier, and the toner images are sequentially transferred to a paper sheet. In this method, since a photoconductive drum must rotate for four turns to form one color image, there is a problem that the image forming speed is low.

Therefore, in recent years, a proposal has been made as to an image forming apparatus of a four continuous tandem method in which four photoconductive drums are disposed so that the image forming speed is increased. In this method, four photoconductive drums are arranged in parallel with each other, on which yellow, magenta, cyan, and black toner images are formed, respectively, and these toner images are sequentially transferred to one sheet of transfer material retained and fed by a transfer material feed belt, to obtain a color image. This photoconductive drum four continuous tandem method has an advantage in that the image forming speed is four times higher than the method as described above.

However, in the image forming apparatus having the four photoconductive drums, a total of four transfer corona chargers for electrostatically transferring toner images formed on photoconductive drums must be respectively provided so as to correspond to the photoconductive drums. In addition, this image forming apparatus requires a suction corona charger for electrically suctioning a transfer material to a transfer material feed belt, and an AC corona discharger or the like for discharging electronic charges remaining on the feed belt, so that these remaining charges do not prevent suctioning effects of the suction corona charger. This method thus uses a greater number of corona discharging generators than the other conventional method described in the beginning, unavoidably resulting in increases in generation of the amount of ozone. Therefore, a large-scale ozone remover apparatus or the like must be installed additionally to cope with the ozone, which leads to a problem in view of costs and down-sizing of the apparatus.

Further, since the photoconductive drum four continuous tandem method reproduces an image of predetermined colors by sequentially feeding a transfer material through four transfer positions thereby overlapping four toner images, a dislocation may be incurred between toner images to be transferred and thus seriously deteriorates the image quality, if the transfer material slips or slides during feeding. In the case of a full-color printer, even a slight dislocation between overlapping positions of respective toner images makes reproduced colors absolutely different from desired colors. Therefore, it is necessary to sufficiently gain a high suction force for suctioning a transfer material against the transfer material feed belt to eliminate dislocations of the transfer material. However, the suction force cannot be increased too high since a mere increase in suction force rather affects transferring of toner images. For these reasons, there is a problem that a color dislocation easily occurs due to an insufficient suction of a transfer material against a transfer material feed member.

SUMMARY OF THE INVENTION

The present invention has been made in view of the above situation, and has a first object of providing an image forming apparatus which is capable of reducing the ozone generation amount without requiring a large-scale ozone removing device, and reducing manufacturing costs and the size of the apparatus.

In addition, the present invention has a second object of providing an image forming apparatus which is capable of reducing the ozone generation amount without requiring a large-scale ozone removing device, and reducing manufacturing costs and the size of the apparatus, and which is also capable of securely maintaining a transfer material on a transfer material feed member by a suction force without causing other affects such as defective transferring of toner and the like, thereby to achieve image formation of high image quality without color dislocations.

To achieve the first object, an image forming apparatus according to the present invention comprises: a plurality of image carriers sequentially arranged in parallel with each other; a plurality of image forming means for respectively forming developer images on the image carriers; supply means for supplying a transfer material onto which the developer images are to be transferred; a conveyer belt arranged to oppose the image carriers, for conveying the transfer material supplied from the supply means through the image carriers; suction means provided on an upstream side of the image carriers in a conveying direction of the conveyer belt, for maintaining the supplied transfer material on the conveyer belt by a suction force; and a plurality of transfer means arranged to oppose the respective image carriers while interposing the conveyer belt therebetween, for respectively transferring the developer images formed on the image carriers, to the transfer material maintained by a suction force and conveyed by the conveyer belt. Further, a conveying speed V (mm/sec) of the conveyer belt, a conveying distance L1 (mm) from a transfer material peeling position corresponding to the image carrier positioned on the most downstream side in the conveying direction of the transfer material, a volume resistance $\rho$ ($\Omega\cdot$cm) of the conveyer belt, and a relative dielectric constant $\epsilon$ of the conveyer belt are set so as to satisfy a relation of $L1/V \geqq (\epsilon\cdot\epsilon_0\cdot\rho)\times 7$.

If the electric characteristics of the conveyer belt are adjusted so as to satisfy the above relation, electric charges remaining on the conveyer belt after image formation is completed and a transfer material is peeled off cease to a level or less at which transferring of the images is not affected before a next transferring cycle starts. As a result, an AC corona discharging device is not necessary for the conveyer belt, so that the ozone generation amount can be reduced and a large-scale ozone removing apparatus is therefore not needed.

In order to achieve the second object, in another image forming apparatus according to the present invention, the suction means described above is omitted from its structure.

Specifically, this image forming apparatus comprises: a plurality of image carriers sequentially arranged in parallel with each other; a plurality of image forming means for respectively forming developer images on the image carriers; supply means for supplying a transfer material onto which the developer images are to be transferred; a conveyer belt arranged to oppose the image carriers, for conveying the transfer material supplied from the supply means through the image carriers; and a plurality of transfer means respectively provided so as to oppose the image carriers with the conveyer belt interposed between the transfer means and the image carriers, for maintaining the supplied transfer material on the conveyer belt by a suction force, and for respectively transferring the developer images formed on the image carriers, to the transfer material, wherein a conveying speed V (mm/sec) of the conveyer belt, a conveying distance L2 (mm) from a transfer material peeling position corresponding to the image carrier arranged in the rearmost position in a conveying direction of the transfer material, a volume resistance ρ (Ω·cm) of the conveyer belt, and a relative dielectric constant ϵ of the conveyer belt are set so as to satisfy a relation as follows:

$$L2/V \geqq (\epsilon \cdot \epsilon_0 \cdot \rho) \times 7$$

Further, in another image forming apparatus according to the present invention, the transfer means respectively include a plurality of transfer members provided in contact with the transfer belt on the side opposite to the image carriers and bias apply means for applying a transfer bias through the transfer members to the transfer material on the conveyer belt, thereby to maintain the supplied transfer material on the conveyer belt by a suction force and to transfer the developer images formed on the image carriers to the transfer material.

Where transfer members kept in planar contact or linear contact with the conveyer belt are used as the transfer means, the conveying speed V (mm/sec) of the conveyer belt, a distance X (mm) between two adjacent image carrier members, the volume resistance ρ (Ω·cm) of the conveyer belt, and a relative dielectric constant ϵ of the conveyer belt are set so as to satisfy relations as follows:

$$X/V \leqq (\epsilon \cdot \epsilon_0 \cdot \rho) \times 15$$

and $$5 \times 10^9 \leqq \rho \leqq 10^{15}$$

In addition, where transfer members each kept in contact with the transfer belt at a plurality of contact points are used as the transfer means, the conveying speed V (mm/sec) of the conveyer belt, a distance X (mm) between two adjacent image carrier members, the volume resistance ρ (Ω·cm) of the conveyer belt, and the relative dielectric constant ϵ of the conveyer belt are set so as to satisfy relations as follows:

$$X/V \leqq (\epsilon \cdot \epsilon_0 \cdot \rho) \times 20$$

and $$5 \times 10^9 \leqq \rho \leqq 15^{15}$$

Even when suction means are omitted from the apparatus, a transfer material can be maintained on the conveyer belt by a suction force by adjusting the electric characteristics of the conveyer belt so as to satisfy the above relations. In addition, an AC corona discharging device is not required any more for discharging the conveyer belt, so that the ozone generation amount can be reduced and a large-scale ozone removing apparatus is not needed. Further, since suction of a transfer material can be sufficiency maintained so that image dislocations might not be caused, image formation of high quality can be achieved without color dislocations.

Additional objects and advantages of the invention will be set forth in the description which follows, and in part will be clear from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 6 show a color printer according to a first embodiment of the present invention, in which:

FIG. 1 is a sectional view showing the entire structure of the color printer, FIG. 2 is a view schematically showing an essential part of the color printer, FIG. 3 is a view showing a relationship between the surface potential of a conveyer belt and a suction force when a paper sheet reaches a sheet suction position, FIG. 4 is a view schematically showing a test machine for changing the surface potential of the conveyer belt moving close to the suction position, FIG. 5 is a view schematically showing a test machine for investigating a relationship of a time-based constant of the belt and the surface potential of the belt, and FIG. 6 is a graph showing a relation between a ratio of the belt moving speed to the time-based constant of the belt and the surface potential of the belt at the suction position in the above-described printer;

FIGS. 7 and 8 show a color printer according to a second embodiment of the present invention, in which:

FIG. 7 is a view schematically showing an essential part of the color printer, and FIG. 8 is a graph showing a relationship between the surface potential of the belt and a proper transfer bias at a first transfer position;

FIGS. 9 to 14 show a color printer according to a third embodiment of the present invention, in which:

FIG. 9 is a view schematically showing the structure of an essential part of the color printer, FIG. 10 is a graph showing a relationship between the belt resistance and the transfer efficiency at a fourth transfer position, FIG. 11 is a rudder chart of the color printer, FIG. 12 is a view illustrating a color dislocation condition, FIG. 13 is a graph showing a relationship between a suction force of a paper sheet and a color (printing) dislocation, and FIG. 14 is a graph showing a relationship between the suction force and a ratio decided by the time-based constant of the belt, a distance between transfer positions, and the belt speed;

FIGS. 16 to 20 show a color printer according to a fourth embodiment of the present invention, in which:

FIG. 16 is a view schematically showing the structure of an essential part of the color printer, FIG. 19 is a graph showing a relationship between the belt resistance and the transfer efficiency at a fourth transfer position, and FIG. 20 is a graph showing a relationship between the suction force and a ratio decided by the time-based constant of the belt, a distance between transfer positions, and the belt speed.

DETAILED DESCRIPTION OF THE PREFERRED EMBODIMENTS

In the following, a first embodiment of the present invention will be explained with reference to FIGS. 1 to 6.

Figure 1:
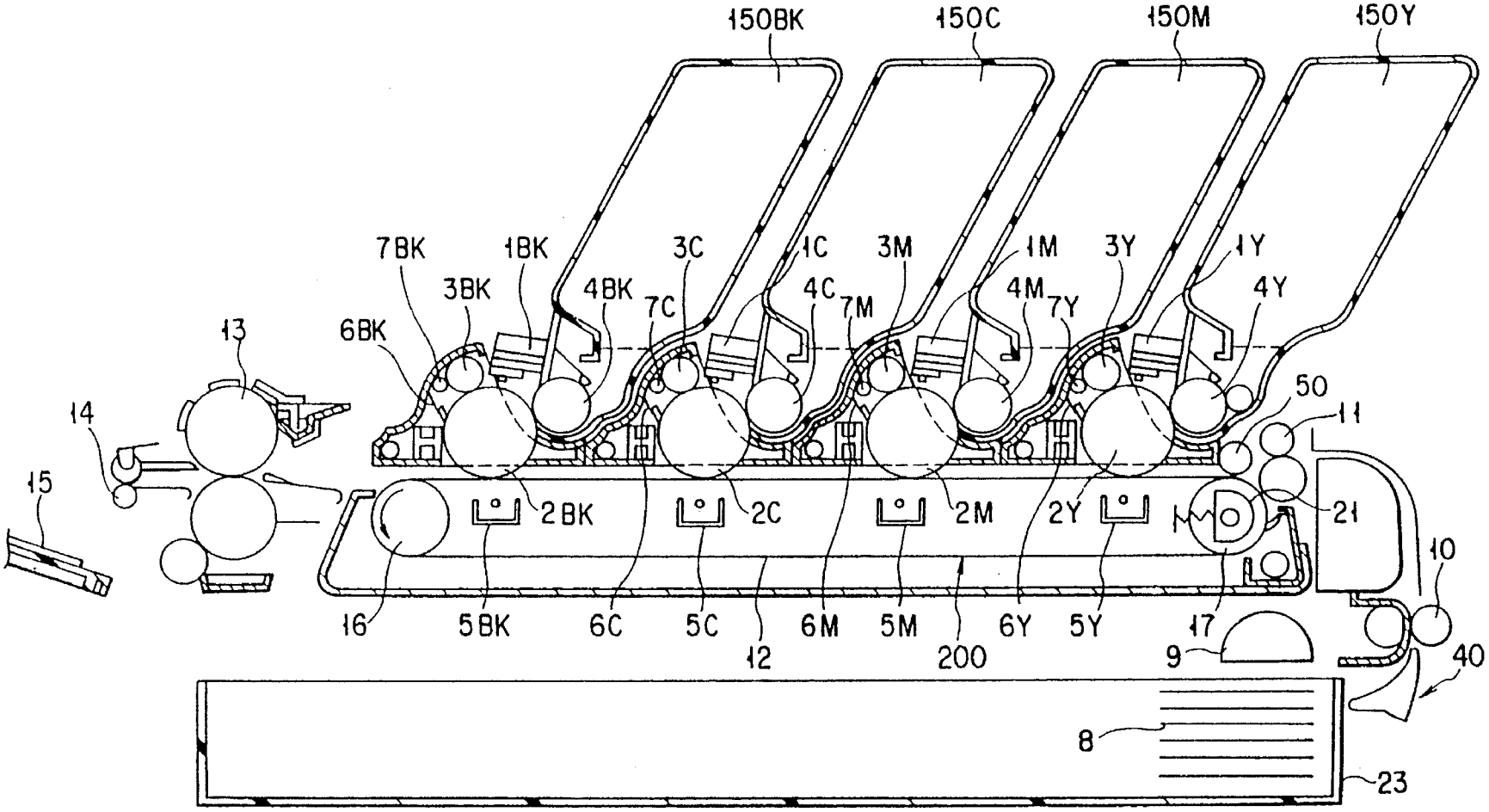
Figure 2:
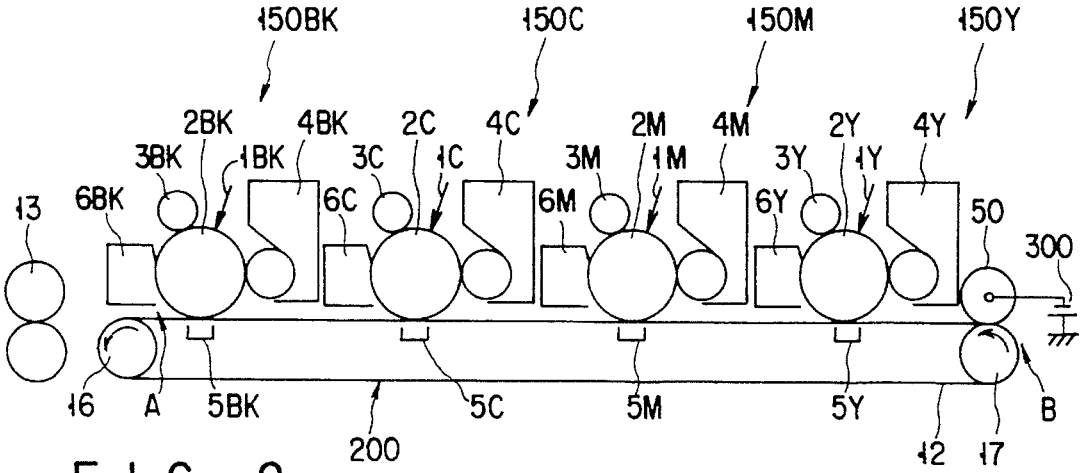
Figure 3:
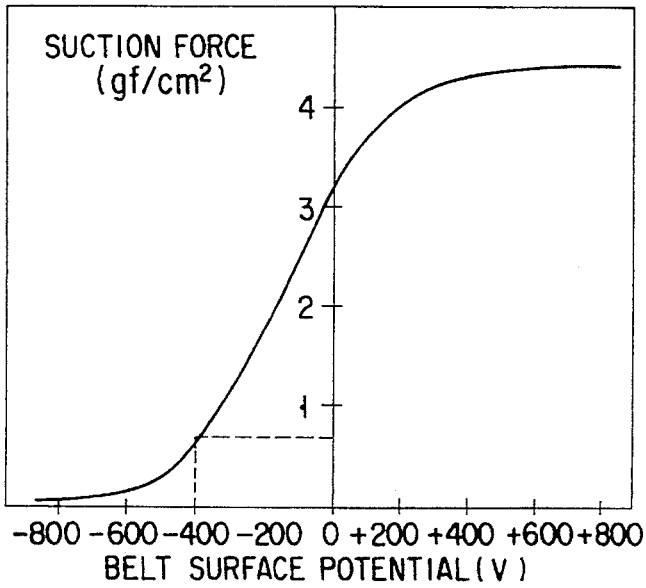

At first, the entire structure of a color printer adopting a four continuous tandem method will be explained with reference to FIGS. 1 and 2. Note that FIG. 2 schematically illustrates a main part of the structure shown in FIG. 1.

This color printer comprises photoconductive drums 2Y, 2M, 2C, and 2BK as four image carriers sequentially arranged in parallel with each other, a plurality of image forming portions 150Y, 150M, 150C, and 150BK respectively provided so as to correspond to the photoconductive drums 2Y, 2M, 2C, and 2BK to form images on the photoconductive drums, a conveyer mechanism 200 for sequentially conveying a paper sheet as a transfer material to the photoconductive drums 2Y, 2M, 2C, and 2BK, and transfer corona chargers 5Y, 5M, 5C, and 5BK as a plurality of transfer means respectively provided so as to correspond to the photoconductive drums 2Y, 2M, 2C, and 2BK to transfer toner images formed on the photoconductive drums 2Y, 2M, 2C, and 2BK, onto the paper sheet 8 conveyed by the transfer mechanism.

The four sets of image forming portions 150Y, 150M, 150C, and 150BK respectively comprise solid scanning heads 1Y, 1M, 1C, and 1BK, recording portions formed of non-magnification image forming optical systems, charger devices 3Y, 3M, 3C, and 3BK, developing devices 4Y, 4M, 4C, and 4BK, cleaning devices 6Y, 6M, 6C, and 6BK, and discharger devices 7Y, 7M, 7C, and 7BK.

The next explanation will be made specifically to the yellow image forming portion 150Y. Note that the magenta image forming portion 150M, the cyan image forming portion 150C, the black image forming portion 150BK each have the same structure as the yellow image forming portion 150Y which will now be explained, and components common to these four image forming portions are denoted by common reference numerals and are distinguished by initial letters Y, M, C, and BK of the colors respectively taken from the yellow, magenta, cyan, and black image forming portions. Therefore, detailed explanation of portions 150M, 150C, and 150BK will be omitted herefrom.

In accordance with image data of yellow supplied from a printing control section not shown, a solid scanning head 1Y outputs an exposure beam to a photoconductive drum 2Y. This solid scanning head 1Y has small light emitting portions which are disposed at equal intervals along the main scanning direction line, and the light emitting portions emit light beams in response to ON/OFF signals supplied from the printing control section in accordance with a pattern to be printed out. Light beams from the light emitting portions are focused on the photoconductive drum 2Y by a non-magnification image forming optical system, thus exposing the surface of the drum.

For example, an LED head array having a resolution of 400 DPI is used as the solid scanning head 1Y, and a cellfock lens array is used as the non-magnification image forming optical system.

The charger device 3Y, solid scanning head 1Y, developing device 4Y, transfer corona charger 5Y, cleaning device 6Y, and discharger device 7Y are provided around the photoconductive drum 2Y.

The photoconductive drum 2Y is driven at a peripheral speed of V0 by a drive motor not shown, such that the printing speed and the processing speed are respectively maintained at 8 sheet/min and 50 mm/sec. The photoconductive drum 2Y is charged to a surface potential of −500 V by the charger device 3Y having a electrically conductive charging roller which is in rolling contact with the surface of the drum. The charging roller constituting the charger device 3Y is connected to a charging bias power source not shown in the figures and is applied therefrom with a charging bias of −1050 V. In addition, the charging roller is rotated by contact with the surface of the photoconductive drum 2Y.

The surface of the photoconductive drum 2Y is formed of an organic photoconductive substance. The photoconductive substance has characteristic that it has a high resistance under normal condition and its specific resistance changes at those portions thereof which undergoes irradiation of light. Therefore, when light beams corresponding to an yellow printing pattern are radiated from the solid scanning head 1Y onto the surface of the charged photoconductive drum 2Y through the non-magnification image forming optical system, an electrostatic latent image of the yellow printing pattern is formed on the drum surface.

An electrostatic latent image is an image formed on the surface of the photoconductive drum 2Y by charging, i.e., a negative latent image formed in such a manner in which irradiation of light from the solid scanning head 1Y causes a decrease in specific resistance at an irradiated portion of the surface of the photoconductive substance thereby allowing electric charges charged on the drum surface to flow out, while electric charges remain at the non-irradiated portion of the drum surface.

The photoconductive drum 2Y on which an electric latent image is thus formed rotates at the speed of V0 to a developing position. Then, the electric latent image on the drum 2Y is developed with toner at this developing position by the developing device 4Y, thereby to form a toner image as a visible image. In the developing device 4Y, yellow toner formed of resin including yellow dyes is prepared. Yellow toner is stirred inside the developing device 4Y so that the toner is charged by friction, and has electric charges of the same polarity as the electric charges charged on the photoconductive drum 2Y. As the surface of the photoconductive drum 2Y passes over the developing device 4Y, yellow toner remains sticking on the latent image portion where charged electric charges are removed, thus developing the latent image with yellow toner (negative development).

The photoconductive drum 2Y on which the yellow toner image is formed continuously rotates at the peripheral speed of V0 and reaches a transfer position opposing to the transfer corona charger 5Y. Meanwhile, a paper sheet is supplied at a predetermined timing by a transfer material supply device 40 as a transfer material supply means described later, and is conveyed while being suctioned and maintained on a conveyer belt 12 formed of an electrically semiconductive belt or a high resistance belt as a transfer material convey member. Then, the toner image is transferred from the photoconductive drum 2Y onto the paper sheet 8, by the transfer corona charger 5Y.

The transfer material supply device 40 comprises a sheet supply cassette 23 in which a number of sheets are stacked, a pick-up roller 9, a pair of feed rollers 10, and a pair of resist rollers 11. Paper sheets are taken out, one after another, from the sheet supply cassette 23 by the pick-up roller 9, and are conveyed by the paired feed rollers 10 to the paired resist rollers 11. Then, the paper sheets are aligned and conveyed to the material conveyer belt 12 by the resist rollers 11. The peripheral speed of the resist rollers 11 and the running speed of the conveyer belt 12 are set to be equal to the peripheral speed V0 of the photoconductive drum 2Y. Then, each paper sheet 8 is fed at the speed V0 to the transfer position of the photoconductive drum 2Y by the conveyer belt 12, while being partially maintained by the paired resist rollers 11.

The conveyer belt 12 is formed of an endless belt, and is stretched between a drive roller 16 as a drive member provided near a fixing device 13 described later and a driven roller 17 as a driven member provided near the paired resist rollers 11. The conveyer belt 12 extends so as to oppose the four photoconductive drums 2Y, 2M, 2C, and 2BK, and runs sequentially through transfer positions corresponding to the four drums. The drive roller 16 and driven roller 17 are formed of metal rollers since a high accuracy is required for these rollers from the viewpoint of preventing the conveyer belt 12 from meandering.

In this embodiment, the conveyer belt 12 is electrically semiconductive and is formed of, e.g., a polyimide belt containing dispersed carbon and having a thickness of 100 μm and a resistance of $10^{13}$ Ω·cm. Note that the material of the conveyer belt 12 is not limited to polyimide, but may be PET, PVDF, urethane rubber or the like.

The drive roller 16 is driven by a drive motor not shown, such that the peripheral speed V0 of the photoconductive drums 2Y, 2M, 2C, and 2BK is equal to the running speed of the conveyer belt 12. In addition, the driven roller 17 has both end shaft portions which are rotatably supported by a pair of support members 21 (one of which is shown in the figure). Each of the support members 21 is urged in the direction moving apart from the drive roller 16, thereby applying a predetermined tension to the conveyer belt 12.

Further, a suction roller 50 which serves as a transfer material suction means for sucking and maintaining a paper sheet 8 on the transfer belt 12 is provided to be in rolling contact with the end portion in the paper sheet supply side of the conveyer belt 12, i.e., the end portion arranged adjacent to the paired resist rollers 11. The suction roller 50 is formed of a rubber roller having a resistance of $10^7$ Ω·cm, and is rotated in interlock with running of the conveyer belt 12. The suction roller 50 is connected with a bias supply power source 300 as a suction bias supply means and is applied with a suction bias.

A paper sheet 8 supplied through the paired resist rollers 11 is electrostatically sucked on the conveyer belt 12 by an electric field generated between the suction roller 50 applied with a suction bias and the driven roller 17 as a grounded metal roller. Note that the suction bias is a voltage of −1500 V of a polarity opposite to the transfer bias.

The suction roller 50 must have a predetermined elasticity and a predetermined resistance in order to form a stable suction nip and to prevent break-down of the belt due to leakage. The rubber hardness of the roller should preferably be within a range of 25 to 70 degree (according to JIS-A), since deformation may occur if the rubber is too soft and nip formation is insufficient if the rubber is too hard.

The resistance of the suction roller 50 is preferably within a range of $10^5$ to $10^{12}$ Ω·cm since a too low resistance may cause break-down of the conveyer belt 12 due to leakage and a too high resistance may result in insufficient formation of a suction electric field. If a bias of plus polarity is applied as the suction bias, a paper sheet 8 is charged with plus electric charges before transfer processing, and transfer of an yellow toner image formed on the photoconductive drum 2Y is thereby started at a position in front of the transfer position, resulting in a transfer blur. Therefore, the suction bias must be a minus polarity opposite to the transfer bias.

In this embodiment, the suction roller 50 consists of a metal shaft having a diameter of 6 mm and electrically conductive urethane rubber provided around the shaft at a thickness of 3 mm. The electrically conductive urethane rubber has a resistance of $10^7$ Ω·cm and a rubber hardness of 55 degree (according to JIS-A).

A paper sheet 8 is fed to a first transfer position where the photoconductive drum 2Y at a first station is in contact with the conveyer belt 12, while being sucked and maintained on the transfer material conveyer belt 12. At the first transfer position, electric charges of plus polarity are applied by the transfer corona charger 5Y from the back-side of the conveyer belt 12, thereby forming an electric field between the conveyer belt and the photoconductive drum 2Y. Due to this electric field, an yellow toner image having a minus polarity is released from the photoconductive drum 2Y and transferred onto the paper sheet 8.

The paper sheet 8 onto which the yellow toner image has thus been transferred is then conveyed so as to sequentially oppose the magenta image forming portion 150M, cyan image forming portion 150C, and black image forming portion 150BK, and magenta, cyan, and black toner images are transferred onto the paper sheet, overlapped over the yellow image in this order.

The paper sheet 8, on which a multi-color overlapped image is formed, peels off naturally from the conveyer belt 12 due to the curvature of the drive roller 16, and is fed into a fixing device 13. The fixing device 13 has a heating roller incorporating a heater and a pressure roller pressed against the heating roller. As the paper sheet 8 passes a fixture point which is a pressed contact portion (or nip portion) between the heating and pressure rollers, the toner image lying on the paper sheet 8, attracted only by a force of electric charges, is melted and pressed against the paper sheet to permanently fix to the paper sheet 8. The paper sheet 8 to which image fixture is completed is fed out onto an sheet outlet tray 15 by a feeder roller 14.

Meanwhile, the portion of the photoconductive drum 2Y which has passed through its transfer position continues rotating at the peripheral speed of V0, and the cleaning device 6Y cleans toner and paper dust remaining on the drum surface. Further, the discharger device 7Y sets the surface potential uniformly to a predetermined potential by means of a discharge lamp. Thereafter, another series of the same processing as described above starting from the charging device 3Y starts again if necessary.

If mono-color printing is performed, image formation is performed by the recording portion and image forming portion corresponding to an arbitrarily selected color. In this case, remaining recording portions and image forming portions other than those related to the selected color are not operated.

In the color printer constructed in the structure as explained above, when a paper sheet 8 passes through the transfer positions corresponding to the photoconductive drums 2Y, 2M, 2C, and 2BK, minus electric charges remain on the surface of the paper sheet 8 due to discharging in combination with the photoconductive drums 2Y, 2M, 2C and 2BK. Therefore, the suction force between the sheet paper and the conveyer belt 12 is increased to be stronger.

After an yellow toner image is transferred to a paper sheet 8, the sheet 8 is conveyed while being sucked and maintained on the conveyer belt 12 until a fourth toner image of black color is transferred at the fourth transfer position. Immediately after the paper sheet 8 passes through the fourth transfer position, it naturally peels off from the conveyer belt 12 due to the curvature of the drive roller 16, and is fed into the fixing device 13 as has been explained above.

Next, consideration is taken into the case where printing is continuously performed. The running distance L which the conveyer belt runs from the fourth transfer position corresponding to the photoconductive drum 2BK to the suction roller 50 is 420 mm and requires a running time of 8.4 sec. Although the surface potential of the conveyer belt 12 is about −700 V immediately after a paper sheet 8 passes the fourth transfer position and peels off (at the point A in FIG. 2), the surface potential of the conveyer belt is −30 V at a point immediately before the belt passes through the suction roller 50 (at the point B in FIG. 2). The electric charges thus detected at the point A are a compilation of electric charges attracted by the paper sheet when the belt passes through each of the transfer positions. If these electric charges remain on the conveyer belt, it is not possible to obtain an electric field for suctioning the paper sheet at a suction portion where the suction roller 50 is provided.

In this respect, a test was performed to check how much electric charges should be eliminated from the conveyer belt to attain a sufficient suction effect at the suction portion.

Figure 4:
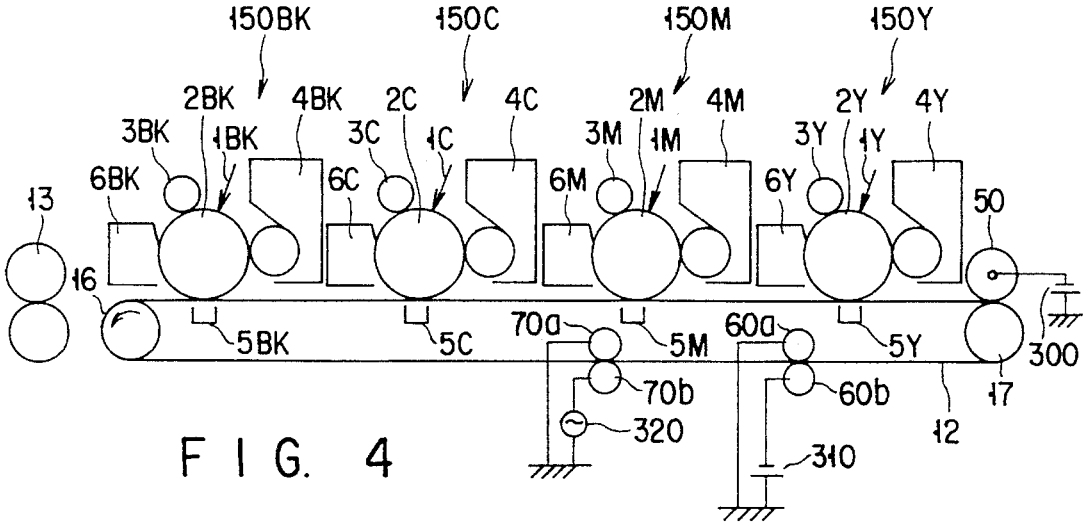

FIG. 4 shows a test machine for changing an entrance potential of the conveyer belt when the conveyer belt enters into the suction position. In this test machine, a pair of rollers 60*a* and 60*b* were provided in the upstream side of the position where a suction roller 50 is provided, and a bias supply power source 310 was connected between the rollers 60*a* and 60*b*. Then, the relationship between the belt potential and the suction force was checked while the surface potential of the conveyer belt 12 when it enters into the suction position was controlled by applying a bias to the conveyer belt 12 through the rollers 60*a* and 60*b*. Note that reference numerals 70*a* and 70*b* in FIG. 4 denote a pair of discharging rollers for discharging the conveyer belt 12, wherein a bias is applied to the discharging roller 70*b* through a bias supply power source 320 as a bias supply means.

The belt suction force was measured immediately after a belt passed through a suction roller 50 with a paper sheet of 1 cm ×20 cm being sucked on the conveyer belt 12 by the suction roller 50. Note that a suction bias generated by the suction roller 50 was −1500 V.

As a result, the followings were found. Specifically, when the surface potential of the conveyer belt 12 was of a small value in the plus or minus side, the suction force was strong. When the belt was charged to a large value in the minus side, the suction force was small. In addition, when the surface potential of the belt 12 had an absolute value smaller than that of −400 V (or +400 V), a suction force equal to or more than a minimum suction force 0.7 gf/cm$^2$ or more was obtained which prevents image dislocations described later.

Next, explanation will be made to the relationship between the resistance of the conveyer belt 12, the dielectric ratio thereof, and the time (L/V) from when the belt passes through a fourth transfer position to when the belt reaches the suction position.

Proper bias conditions differ between transfer positions for toner images of respective colors, depending on the resistance of the conveyer belt 12 and dielectric ratio. However, the potential of the belt due to electric charges remaining on the belt, the potential of the belt ranges within a range of −500 to −800 V under proper conditions, even when the resistance and the dielectric ratio differ.

For example, the transfer conditions at respective transfer positions are as follows where a conveyer belt 12 having a volume resistance of $10^{12}$ Ω·m is used to transfer images onto paper. At the first transfer position, a proper range of the transfer bias is −800 to −1100 V. At the second transfer position, a proper range of the transfer bias is −850 to −1200 V. At the third transfer position, a proper range of the transfer bias is −900 to −1250. At the fourth transfer position, a proper range of the transfer bias is −1000 to −1400. Where a conveyer belt 12 having a volume resistance of $10^{13}$ Ω·m is used to transfer images on paper, proper transfer bias ranges at the first to fourth transfer positions are respectively −1000 to −1300 V, −1050 to −1350 V, −1100 to −1450 V, and −1300 to −1600 V.

The higher the volume resistance of the conveyer belt is, the higher the proper transfer bias ranges at respective transfer positions are. If the above proper transfer bias conditions are satisfied, the electric potential of the conveyer belt substantially is within a range of −500 to −800 immediately after the belt leaves the photoconductive drum at the fourth transfer position.

Figure 5:
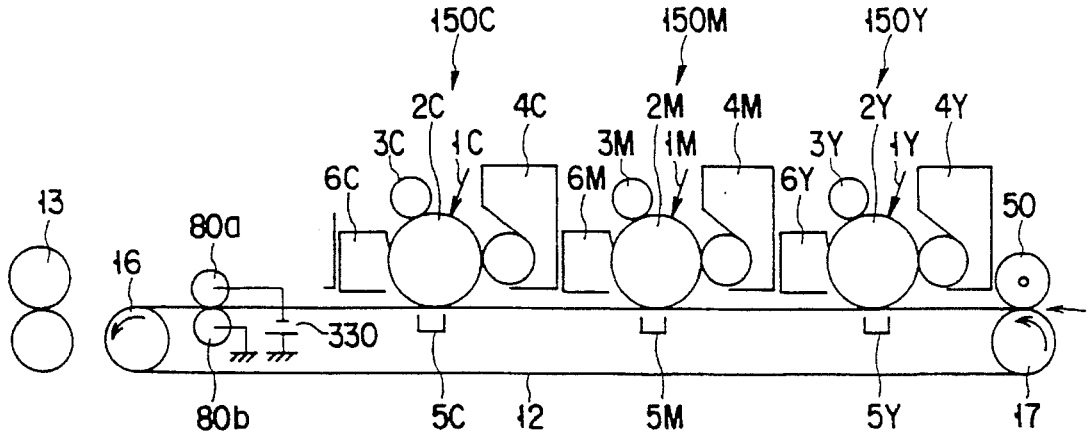

Therefore, as shown in FIG. 5, after charging the conveyer belt 12 to about −700 V at the fourth position by a roller 80*a* connected with a bias supply power source 330 as a bias supply means and a grounded roller 80*b*, the surface potential of the belt (i.e., the potential at the point B shown in the figure) when it reached the suction position was measured, while changing the dielectric ratio, the volume resistance, and the moving speed of the belt.

For example, the running distance L of the conveyer belt 12 is fixed to 420 mm, while the moving speed V of the belt is changed from 20 to 100 mm/sec, the dielectric ratio of the belt is changed from 3 to 13 by replacing the base material of the belt with PET, PVDF, urethane rubber or the like, by changing the kinds of carbon dispersed in the base material, or by dispersing titanium oxide, silica, or the like in addition to carbon. The volume resistance u was changed from $10^{12}$ to $10^{15}$ Ω·m by changing the dispersion amount of carbon contained in the base material of the belt.

As a result of this, it is possible to change the bolt time-based constant τ within a range from 0.027 to 100, the L/V within a range from 21 to 4.2, and the (L/V)/τ within a range from 0.042 to 778.

Figure 6:
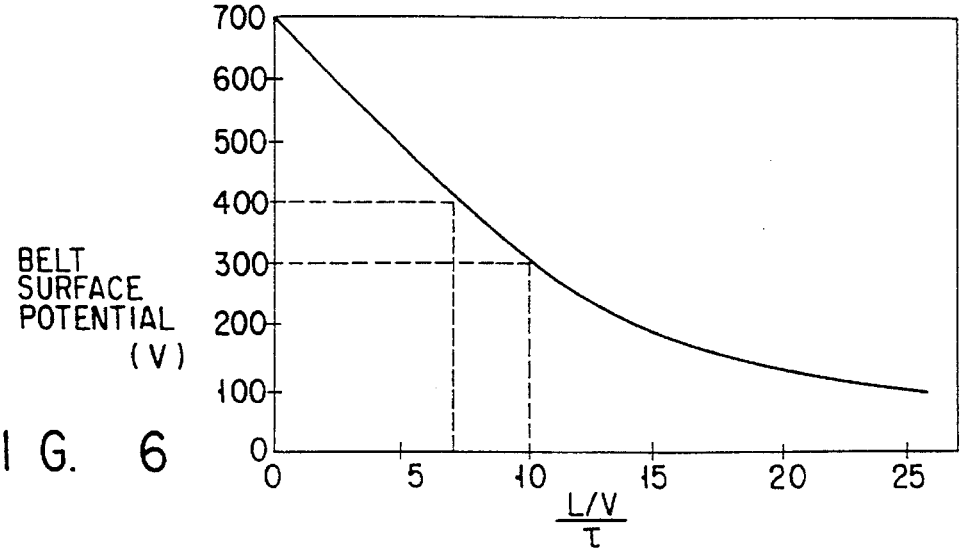

The measurement results are shown in FIG. 6. From the results, it is apparent that the surface potential of the belt is smaller than −400 V when the time (L/V) required until the conveyer belt 12 reaches the suction position from the fourth transfer position is as seven times large as the time-based constant τ of the belt.

Specifically, it is apparent from the results that the potential of the belt when the belt enters into the suction roller 50 is sufficiently damped to a potential enough to suck a paper sheet 8 and an excellent image can be obtained without color dislocations, if the moving speed V (mm/sec) of the transfer material conveyer belt 12, the distance L1 (mm) from the fourth transfer position as the last station to the suction position in the next transfer cycle, the volume resistance ρ (Ω·cm), and the relative dielectric ratio ϵ satisfy the following relation:

$$L1/V \geqq (\epsilon \cdot \epsilon_0 \cdot \rho) \times 7$$

where $\epsilon\ 0 = 8.854 \times 10^{-12}$ F·m=$8.85 \times 10^{-15}$ F/mm.

According to a color printer constructed in the structure described above, the conveying speed V (mm/sec), the running distance L1 (mm) of the conveyer belt 12 to the suction position from a sheet peeling position corresponding to the photoconductive drum of the fourth transfer position situated in the last stage in the down-stream side in the conveying direction of the paper sheet, the volume resistance ρ (Ω·cm), and the relative dielectric ratio ϵ are arranged so as to satisfy the relation of $L1/V \geqq (\epsilon \cdot \epsilon_0 \cdot \rho) \times 7$.

Thus, by adjusting electric characteristics of the conveyer belt, electric charges remaining on the conveyer belt after image formation is completed and a paper sheet is peeled off are eliminated to a level or less at which transferring of the images is not affected before a next transferring cycle starts. As a result, an AC corona discharging device which is conventionally required and which generates an extremely large amount of ozone is not necessary any more for discharging the conveyer belt. Therefore, the ozone generation amount can be reduced and a large-scale ozone removing apparatus is not needed, so that cost-down and down-sizing of a color printer can be achieved without using a large-scale ozone removing apparatus.

In the next, a color printer according to a second embodiment of the present invention will be explained with reference to FIGS. 7 and 8. Note that only those components of the second embodiment which are different from the components of the first embodiment will be explained in the explanation of the second embodiment, and the components common to these embodiments are denoted by common references, to omit reiterative explanation of such components.

Figure 7:
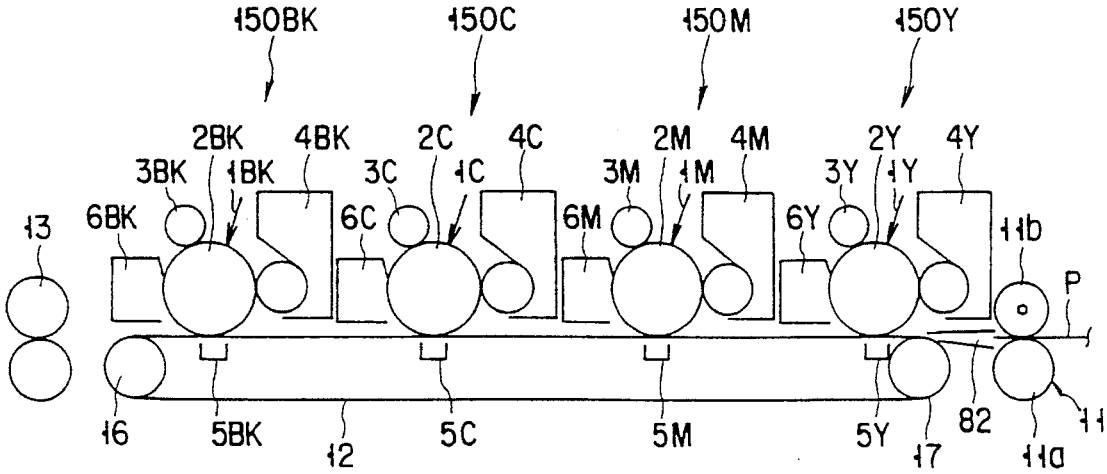

As shown in FIG. 7, the color printer according to the second embodiment is constructed in a structure which does not include a transfer material suction roller 50. Specifically, in this printer, a paper sheet 8 is supplied to a first transfer position through a sheet guide 82 by a pared resist rollers 11 consisting of a drive roller 11*a* and a pinch roller 11*b*. An yellow toner image as a first image is transferred onto the paper sheet 8 by the operation of the transfer corona charger 5Y at the first transfer position, and the sheet paper 8 is simultaneously sucked on the conveyer belt 12.

This color printer is the same as the color printer according to the first embodiment, including the structure of processing, the resistance of the conveyer belt, the material thereof, the thickness thereof, and the like, except that the printer of the second embodiment does not include a suction roller 50. The processing speed is 50 mm/sec and the moving distance of the conveyer belt 12 from the fourth transfer position to the first transfer position is 400 mm.

In the second embodiment, the start position of a next transfer cycle is equal to the first transfer position. The proper conditions for the first to fourth transfer positions directly apply to the second embodiment. However, these proper transfer conditions are limited to a state where the printer is left in a nonoperating state for a predetermined time period and electric charges do not remain on the conveyer belt 12. If a potential remains on the belt when continuous printing is performed, proper bias conditions of transfer are different.

Figure 8:
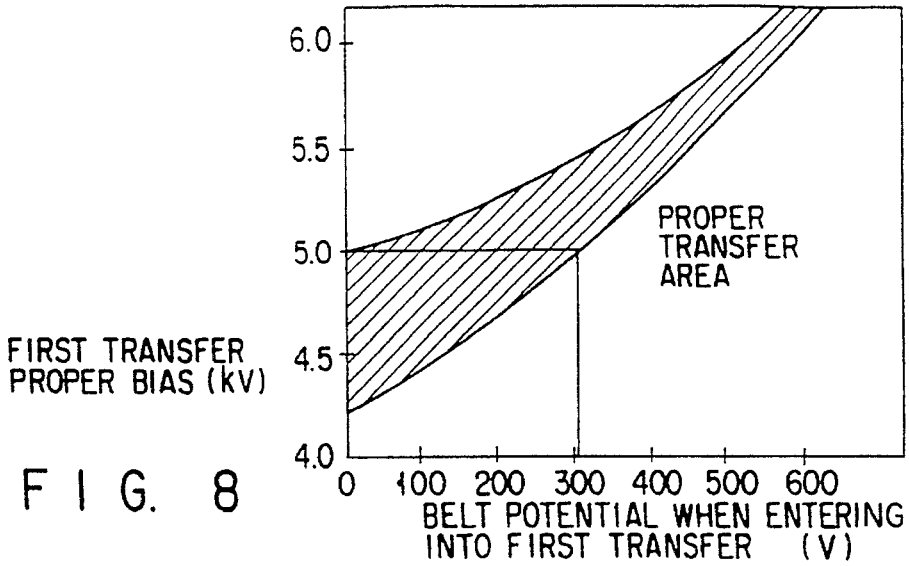

FIG. 8 shows a relationship between the surface potential of the conveyer belt 12 when the belt enters into the first transfer position and the proper transfer bias condition at the first transfer position at the same time. The greater the remaining electric charges of the conveyer belt 12 are, the higher the proper transfer condition is. When the surface potential of the belt gained by the remaining charges rises to −300 V or higher, defective transfer is caused at a proper bias when no electric charges remain (i.e., when the surface potential is 0 V).

Specifically, if continuous printing is performed, electric charges existing on the surface of the belt must be damped when the belt passes through the fourth transfer position, such that the surface potential is smaller than −300 V when the belt reaches the first transfer potential. Otherwise, continuous printing cannot be achieved under constant transfer conditions.

In order to obtain a remaining electric potential smaller than −300 V at the first transfer position as a starting position of the next cycle thereby to achieve excellent transfer, the moving speed V (mm/sec) of the transfer material conveyer belt 12, the distance L2 (mm) from the fourth transfer position to the first transfer position as the starting point of the next transfer cycle, the volume resistance ρ (Ω·cm), and the relative dielectric ratio ϵ must satisfy the following relation:

$$L2/V \geqq (\epsilon \cdot \epsilon_0 \cdot \rho) \times 10$$

In the second embodiment, respective values are L2=400 mm, V=50 mm/sec, ϵ=9, and $\rho = 10^{13}$ Ω·cm and satisfy the above relation. Therefore, an excellent image is obtained when continuous printing is performed without discharging the conveyer belt 12.

According to a color printer constructed in the above structure, it is possible to suck a paper sheet with use of a transfer material without providing a transfer material suction means for sucking and maintaining a paper sheet on the conveyer belt, if electric characteristics of the conveyer belt as a transfer material conveyer member are adjusted so as to satisfy the relation of $L2/V \geqq (\epsilon \cdot \epsilon^0 \cdot \rho) \times 10$. Further, an AC corona discharging device which is conventionally required and which generates an extremely large amount of ozone is not necessary any more for discharging the conveyer belt, like in the first embodiment. Therefore, the ozone generation amount can be reduced and a large-scale ozone removing apparatus is not needed, so that cost-down and down-sizing of a color printer can be achieved without using a large-scale ozone removing apparatus.

In the next, a color printer according to a third embodiment of the present invention will be explained with reference to FIGS. 9 to 14. Note that only those components of the third embodiment which are different from the components of the first embodiment (see FIG. 2) will be explained in the explanation of the second embodiment, and the components common to these embodiments are denoted by common references, while omitting reiterative explanation of such components.

Figure 9:
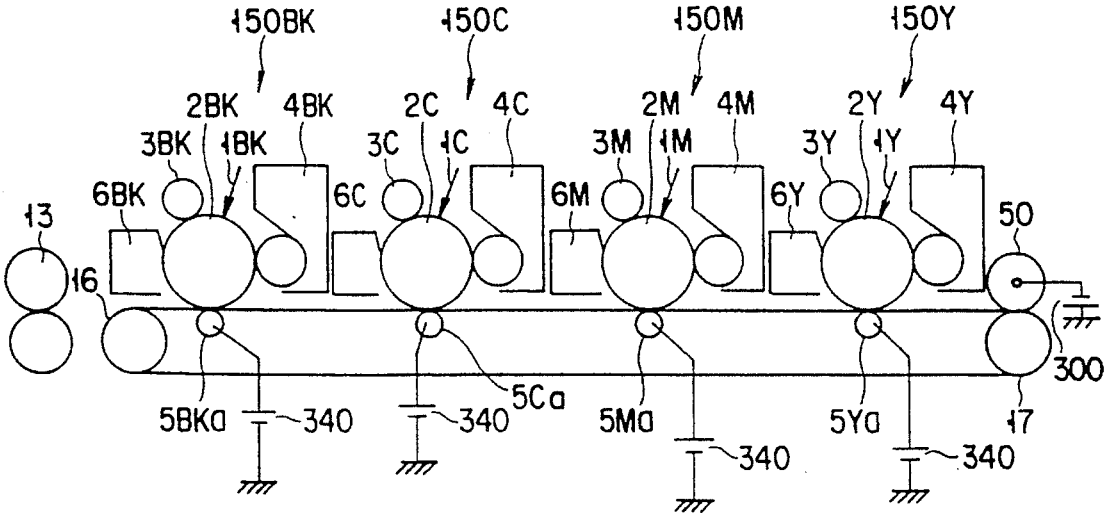

As shown in FIG. 9, according to the third embodiment, transfer rollers 5Ya, 5Ma, 5Ca, and 5BKa as contact-type transfer means which have a planar or linear contact with the conveyer belt 12 are used in place of transfer corona charger device 5Y, 5M, 5C, 5BK as non-contact type transfer means. The processing speed is set to 25 mm/sec which is slower than that of the first embodiment. The printing speed is 4 sheet/min, and the distance between transfer positions is 75 mm. The conveyer belt 12 is made of polyimide containing carbon dispersed therein, and has a dielectric ratio of 9, a volume resistance of $5\times10^{12}$ (Ω·cm), and a thickness of 100 μm.

The transfer rollers 5Ya, 5Ma, 5Ca, and 5BKa are respectively connected with bias supply power sources 340, and are also respectively applied with 1000 V, 1050 V, 1150 V, and 1300 V as their transfer biases.

In the next, the resistance and transfer performance of the conveyer belt 12 will be explained.

Figure 10:
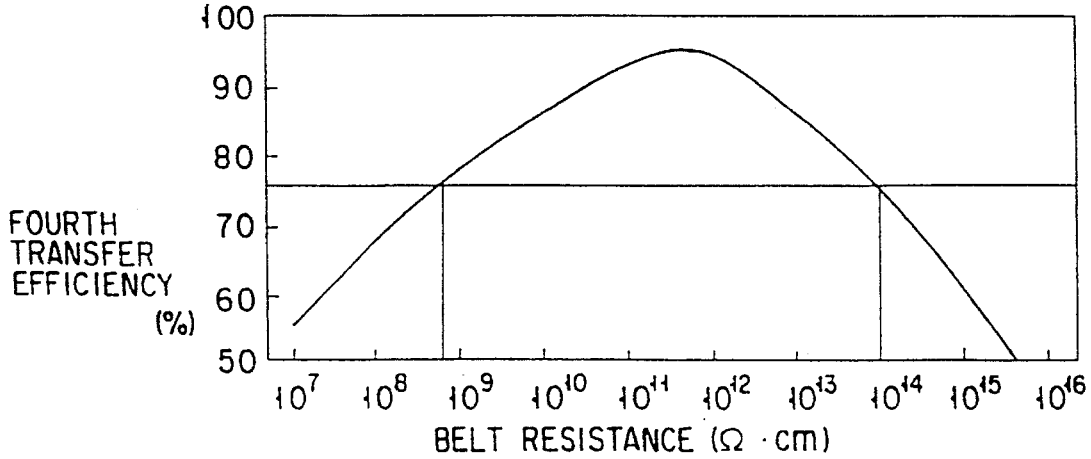

The fourth transfer is more difficult than the first transfer. As shown in FIG. 10, a test was performed to check a relationship between the resistance of the belt and a transfer efficiency of an absolute black image in the fourth transfer where the transfer bias thereof was optimized in compliance with the resistance value of the belt. The transfer efficiency was calculated by the following equation and an excellent image was obtained when the transfer efficiency is 75% or more.

Transfer efficiency =image density/(density of a sample whose transfer residue subjected to taping +image density)

Note that density was measured with use of a Macbeth RD918.

As is apparent from FIG. 10, the lower the resistance of the belt is, the lower the proper transfer conditions are shifted. Where the resistance is $5\times10^{8}$ Ω·cm or less or is $10^{14}$ Ω·cm or more, there are no proper transfer conditions.

A paper sheet 8 is sucked on the conveyer belt 12 by the suction roller 50, and enters into the first transfer position. At the first transfer position, an yellow toner image is transferred and minus electric charges remain on the surface of the paper sheet 8 due to discharging when the paper sheet 8 leaves the photoconductive drum 2Y. These minus electric charges remaining on the paper sheet 8 continuously keep the paper sheet sucked on the transfer belt 12. Hence, a charge maintaining force is required to maintain a certain amount of electric charges until the paper sheet 8 reaches the next transfer position.

If the paper sheet 8 cannot be electrostatically kept tacked on the transfer belt 12 after the paper sheet 8 passes through a transfer position until it reaches a next transfer station, the running of the paper sheet 8 becomes instable and causes a color dislocation. Electric charges remaining on the paper sheet 8 are damped in accordance with the time-based constant dependent on the paper sheet 8 and the conveyer belt 12. Although the resistance of the paper sheet 8 changes within a range of $10^{5}$ to $10^{11}$ Ω·cm under circumstances, the time-based constant is decided by the characteristics of the conveyer belt 12 if the resistance of the conveyer belt 12 (which is $5\times10^{12}$ and is substantially constant independently from the circumstances) is sufficiently high. Since the conveyer belt 12 has a dielectric ratio of 9, a time-based constant $\tau=\epsilon\cdot\tau0\cdot\rho=45$ is obtained.

In the printer shown in FIG. 9, taking into consideration that the distance between transfer stations and the processing speed are respectively set to 75 mm and 20 mm/sec, the moving speed of the conveyer belt 12 is about 3 seconds which is greater than the time-based constant.

Therefore, a measurement of a suction force was performed under the following conditions. Specifically, second to fourth image forming stations of magenta, cyan, and black colors were removed, and a string is attached to a paper sheet 8 of 1 cm×20 cm which is longer in the lateral direction. The paper sheet was made to pass through the first image forming station in transfer ON state and the operation of the printer was then stopped immediately after the paper sheet passed the first image forming station. After three seconds (which is an inter-station time in this embodiment), the suction force was measured while pulling the paper sheet in a direction parallel with the belt running direction by a spring balance. The measured suction force was 60 gf.

This suction force is equivalent to a suction force per unit area of 3 gf/cm$^2$, and therefore it is that the paper sheet is sufficiently sucked on the conveyer belt 12. Actually, test printing of a rudder chart was carried out to cause a color dislocation of only 35 μm at most, which was of a level causing no problems.

Figure 11:
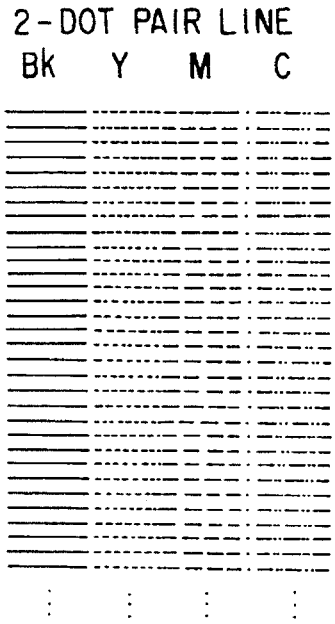
Figure 12:
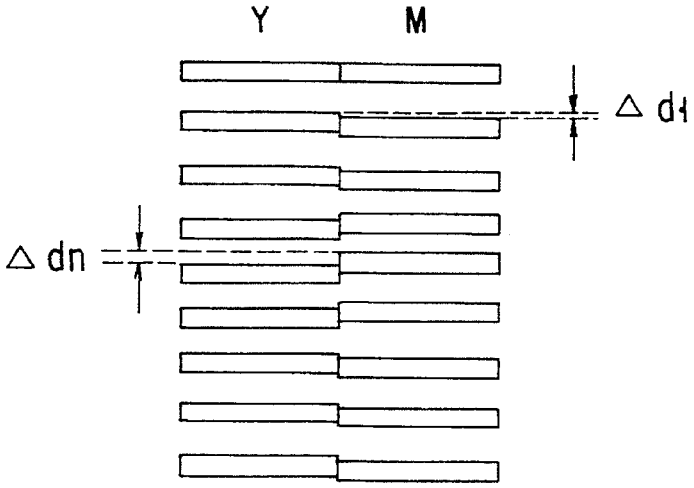
Figure 13:
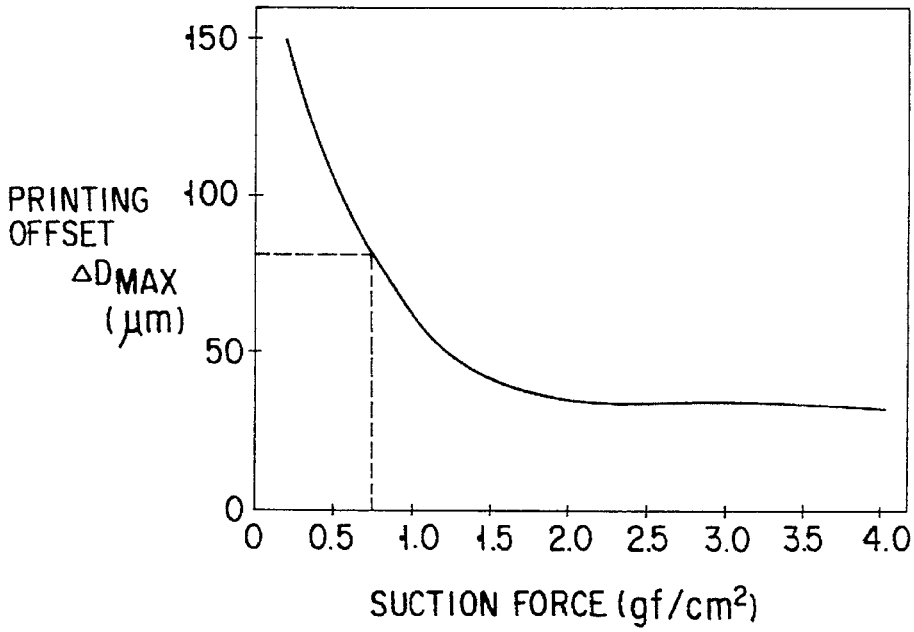

Next, the relationship between the printing dislocation tolerance and the printing dislocation will be explained. A rudder chart of 2-dot pair line was used as an evaluation chart, as shown in FIG. 11. With respect to measurement of printing dislocations, an image analysis device available from Tokyo Hikari Denshi was used and a position dislocation Δ d in the sub-scanning direction as shown in FIG. 12 was measured.

Among values of Δ d measured with respect to the entire surface of a paper sheet of A4 size, the maximum value Δ dmax obtained by cutting off 5% of the largest value is defined as a value representing a printing dislocation. The suction force of the paper sheet 8 to the conveyer belt differs depending on parameters such as the resistance unique to the conveyer belt 12, the thickness of the belt, the dielectric ratio thereof, the intensity of a transfer electric field and the likes. The suction force and printing dislocation were measured while changing these parameters. Besides, a grid having equal edges of 3 mm was printed to be overlapped, and printing dislocation was checked with eyes. The results were shown in FIG. 13.

When a printing dislocation exceeds 50 μm, the dislocation can be observed with eyes, and when a printing dislocation exceeds 80 μm, it can be clearly recognized. Hence, a practical limit value of a printing dislocation may be decided to be 80 μm. From the relationship between the suction force and the printing dislocation shown in FIG. 13, a suction force required when the belt reaches to a next station was determined to be 0.7 gf/cm$^2$ or more. In this embodiment, the suction force was 3 gf/cm$^2$, and there fore the printing dislocation was 35 μm. This printing offset was of a level which does not cause any problem. Thus, the suction force required for the next station was maintained, which means that electric charges of a minus polarity opposite to the transfer polarity described above remained on the conveyer belt 12. This indicates that the transfer bias increases to be higher and higher as the paper sheet passes through the second and more transfer positions, in comparison with the first transfer position.

In fact, although the transfer bias of the first transfer roller 5Ya was 4.2 to 5.0 kV, the transfer bias increased to be 4.6 to 5.3 kV at the second transfer roller 5Ma, 5.2 to 5.7 kV at the third transfer roller 5Ca, and 6.0 to 6.3 kV at the fourth transfer roller 5BKa. In case where transfer electric charges of a preceding stage remain on the conveyer belt 12, consideration should be taken into a fact that a proper transfer area is reduced in a later stage. Therefore, some portion of suction electric charges applied by a transfer operation should desirably remain until a next transfer position, while another portion of the suction electric charges should be eliminated.

An excellent condition which ensures excellent transfer and does not cause a printing dislocation is a condition where the suction force should not be reduced to be 0.7 gf/cm$^2$ or less until a paper sheet reaches to a next transfer position after a suction force of 2 to 4 gf/cm$^2$ is once applied thereto by a transfer roller or suction roller 50 and where excellent transfer is achieved (normally, 20 to 80% of electric charges once applied by transfer are naturally reduced).

Therefore, the suction force when the paper sheet reaches the second transfer position was measured while changing the resistance of the belt, the dielectric ratio, and the processing speed, under condition that the transfer bias was adjusted such that the suction force for the paper sheet 8 was substantially about 3 gf/cm$^2$ after a sheet of paper passes through the first transfer position.

Figure 14:
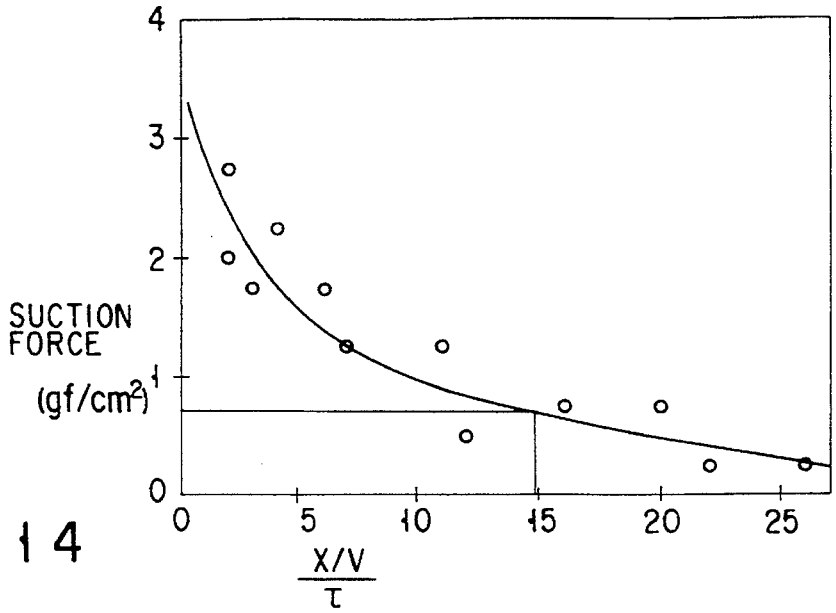
Figure 15:
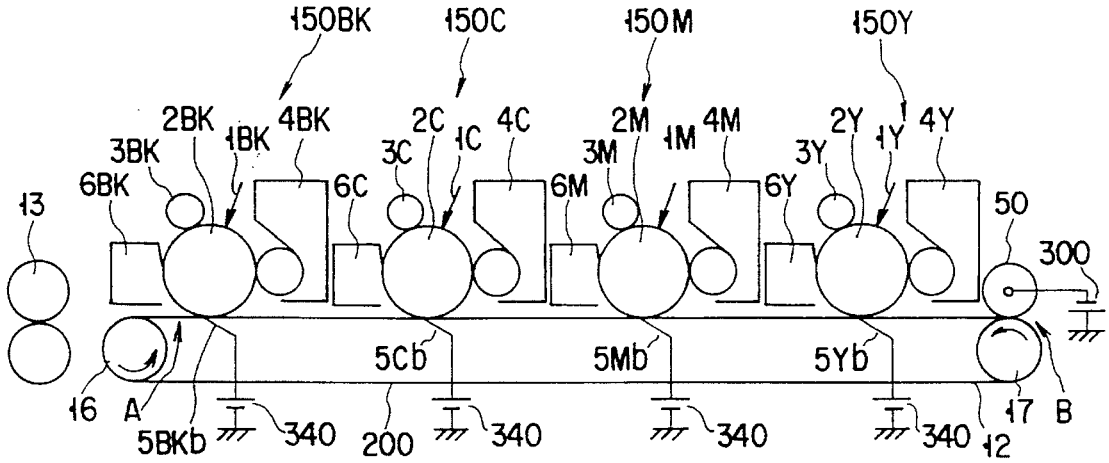
FIG. 15 is a view schematically showing the structure of an essential part of a color printer according to a modification of the third embodiment.

FIG. 14 shows a relationship between the suction force and the ratio of the time between the first and second transfer positions to the belt time-base constant $\tau$. When the time between transfer positions is not 15 times longer than the belt time-based constant, the necessary suction force of 0.7 gf/cm$^2$ is maintained.

Specifically, a printing dislocation does not occur if the following condition is satisfied.

$$L/V \geqq (\epsilon \cdot \epsilon_0 \cdot \rho) \times 15$$

The printer of this embodiment shown in FIG. 9 which satisfies the above relation does not cause a printing dislocation but achieves an excellent transfer image.

In the third embodiment, electrically conductive EPDM rollers each having a resistance of $10^7$ Ω·cm are used for transfer rollers 5Ya, 5Ma, 5Ca, and 5BKa each of which is shaped in a roller having a diameter of 14 mm including rubber material of 4 mm thickness provided around a metal shaft having a diameter of 6 mm. The hardness of rubber material is 45 degree (according to JIS-A). In addition, each the transfer rollers 5Ya, 5Ma, 5Ca, and 5BKa is arranged to be rotated in contact with the conveyer belt 12, and therefore, the rollers cannot be smoothly rotated if the rubber material does not have a certain degree of hardness. However, if the rubber material is too hard, a proper transfer nip cannot be formed. Therefore, hardness of 30 to 80 degree is desirable. Further, if the resistance of each transfer roller is $10^4$ Ω·cm or less, break down of the belt is caused, while a sufficient transfer electric field cannot be generated if the resistance is not lower than the resistance of the belt by two orders or more.

Transfer rollers consisting of solid rollers are used as contact-type transfer means each of which has a planer or liner contact with the conveyer belt in the third embodiment. However, it has been confirmed that printing dislocations do not occur like in that embodiment as long as the above equation is satisfied, if those transfer rollers are substituted by transfer members 5Yb, 5Mb, 5Cb, and 5BKb each of which has a plate-like member such as an urethane rubber blade, a silicon rubber blade, or a resin sheet made to be electrically conductive and is connected to a bias supply power source 340 as a bias supply means.

According to a color printer having the above structure, transfer rollers which have planer or linear contacts with the conveyer belt on its back surface at positions respectively corresponding to photoconductive drums and which are applied with transfer biases are provided, and further, conveying speed V (mm/sec) of paper sheets, the distance X (mm) between photoconductive drums, the volume resistance $\rho$ (Ω·cm), and the relative dielectric ratio $\epsilon$ of the conveyer belt are arranged so as to satisfy relations of $X/V \leqq (\epsilon \cdot \epsilon_0 \cdot \rho) \times 15$ ands $5 \times 10^8 \leqq \rho \leqq 10^{14}$.

Since contact-type transfer means each having a planar or linear contact with the belt are thus used to perform transfer without performing corona transfer, cost-down and downsizing of a color printer can be achieved while reducing the ozone generation amount of the entire printer, without using a large-scale ozone removing apparatus. In addition, when a transfer member of contact-type such as a solid roller, a film sheet, or the like is used, suction of a paper sheet can be sufficiently maintained so that image dislocations might not occur, and therefore, image formation of a high image quality can be achieved with less color dislocations.

In the next, a color printer according to a fourth embodiment of the present invention will be explained with reference to FIGS. 16 and 20. Note that only those components of the fourth embodiment which are different from the components of the first embodiment will be explained in the following explanation of the fourth embodiment, and the components common to these embodiments are denoted by common references, to omit reiterative explanation of such components.

Figure 16:
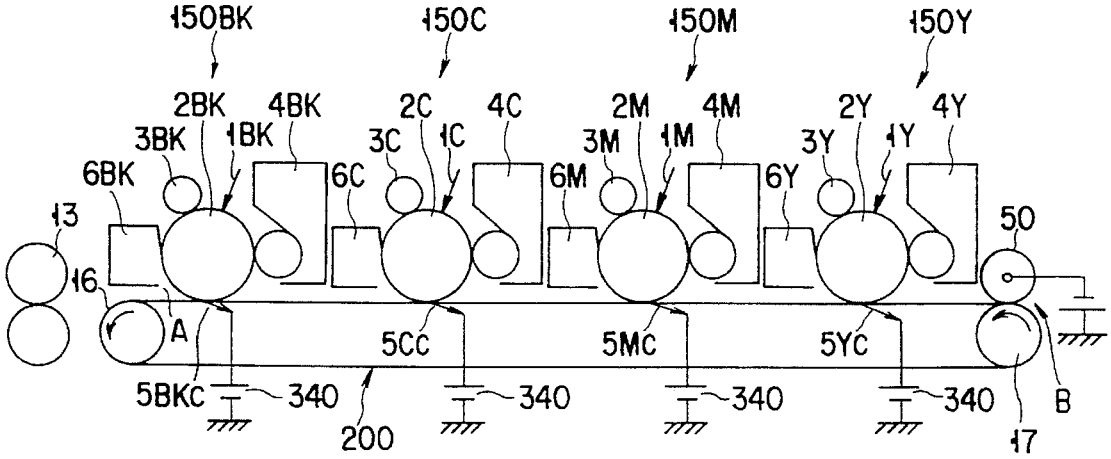

As shown in FIG. 16, this color printer comprises transfer brushes 5Yc, 5Mc, 5Cc, and 5BKc as contact-type transfer means each of which is in contact with the conveyer belt 12 at a number of contact points, in place of corona dischargers. Each of these transfer brushes is connected with a bias supply power source 340 as a bias supply means. The resistance of the conveyer belt 12 is set to $10^{13}$ Ω·cm. Except for these respects, this printer has the same structure as the first embodiment.

Figure 17A:
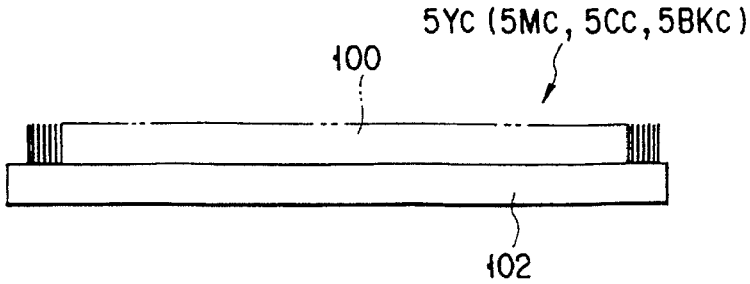
FIGS. 17A and 17B are front and side views of a transfer brush.
Figure 17B:
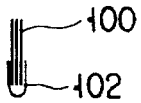

Each of the transfer brushes 5Ya, 5Mc, 5Cs, and 5Bkc has a structure in which brush fibers 100 are supported by an aluminum plate 102, as shown in FIGS. 17A and 17B. The brush fibers have a length of 7 mm, a thickness of 6 D (denier), a fiber density of 160,000 fibers/inch, and a resistance of $10^8$ Ω·cm. The transfer brushes 5Yc, 5Mc, 5Cc, and 5BKc are lined with Mylar (trade name) of 100 μm thickness (not shown), and have a structure in which brush fibers 100 are pressed against the conveyer belt 12 from the back side of the belt.

The resistance of the brushes has a proper range of $10^5$ to $10^9$ Ω·cm. If the resistance is too low, a leakage occurs, while defective transfer is caused if the resistance is too high. Note that the upper limit of the proper resistance range depends on the resistance of the conveyer belt, and must be lower than the resistance of the belt by 1.5 orders or more. A transfer electric field cannot be formed the upper limit must be lower than the resistance of the belt by 2 orders or more, in case of a transfer roller. However, since a brush has a higher discharging efficiency than a transfer roller, transfer can be performed if the upper limit is lower than the resistance of the belt by only 1.5 orders.

A proper range of the brush fiber density is 10,000 to 400,000 fibers/inch. If the fiber density is lower than this range, a stripe-like pattern appears in a transfer image. A brush having a higher density exceeding this range cannot be manufactured. In addition, the thickness of a brush fiber 1 to 10 D (denier). A brush fiber is broken if it is too thin. If it too thick, a stripe-like pattern appears as stated above.

Figure 19:
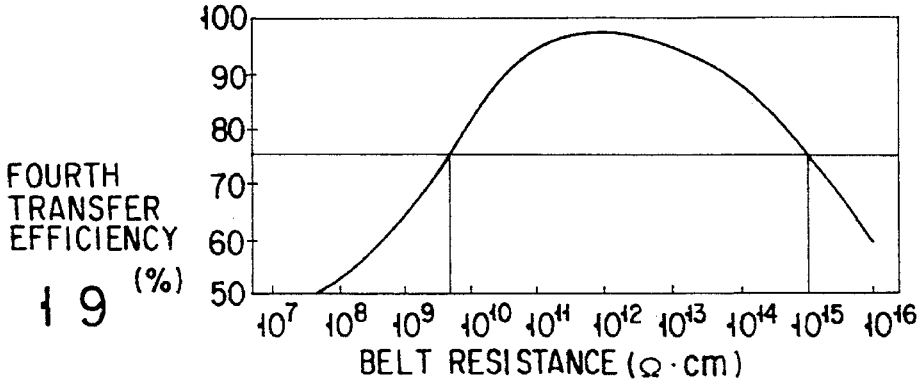

If transfer brushes 5Yc, 5Mc, 5Cc, and 5BKc each having a number of contact points with the conveyer belt 12 are thus used, the range of the proper resistance of the belt shifts from the proper range where the transfer members each having a planar or linear contact are used. FIG. 19 shows results of measurements performed on the fourth embodiment where the transfer efficiency was measured with a proper transfer bias while changing the resistance of the belt. As is known from this figure, the proper resistance of the belt shifts to the side of a higher resistance. The proper transfer condition is obtained when the resistance of the belt is within a range of $5 \times 10^9$ to $10^{15}$ Ω·cm.

Figure 20:
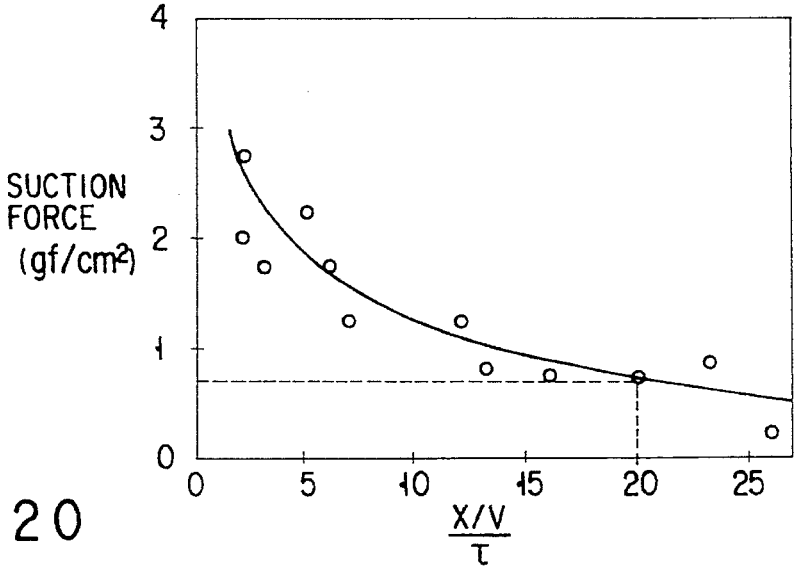

FIG. 20 shows the relationship between the ratio of the time between transfer positions (X/V) to the time-based constant $\tau$ and the suction force. As is apparent from FIG. 20, the suction force of the conveyer belt 12 is stronger in comparison with a case of using transfer rollers. Transfer members such as transfer rollers each having a planar or linear contact with the conveyer belt apply electric charges to the back surface of the belt by substantially ideal Paschen discharging. In contrast, transfer members each having a number of contact points apply electric charges by localized discharging different from the Paschen discharging. This difference in form of discharging is considered as causing a difference in potential damping.

As has been explained above, when transfer members each having a number of contact points are used, a suction force of 0.7 gf/cm$^2$ which prevents printing dislocations can be obtained if only X/V is smaller than a value twice or more larger than the time-based constant $\tau$, i.e., if X/V satisfies the following relation.

$$X/V \leqq (\epsilon \cdot \epsilon_0 \cdot \rho) \times 20$$

In this embodiment, X=75 mm, V=25 mm/sec, $\epsilon$=9, and $\rho=10^{13}$ $\Omega$·cm are defined, and these values satisfy the above relation. Therefore, an excellent image is obtained without printing dislocations.

According to a color printer constructed in the above structure, contact-type transfer members such as transfer brushes each having a contact with the back surface of the conveyer belt at a number of contact points, and the relations of $X/V \leqq (\epsilon \cdot \epsilon_0 \cdot \rho) \times 20$ and $5 \times 10^9 \leqq \rho \leqq 10^{15}$ are satisfied.

Since transfer is thus performed with use of contact-type transfer means without using corona transfer, the ozone generation amount of the entire printer can be reduced, and cost-down and down-sizing of a color printer can be achieved without requiring a large-scale ozone removing apparatus. In addition, when transfer members of a contact type such as solid rollers, film sheets, and the likes are used, it is possible to sufficiently maintain suction of a paper sheet so that image dislocations might not be caused, and to achieve image formation of an image quality which does not include color dislocations.

Figure 18A:
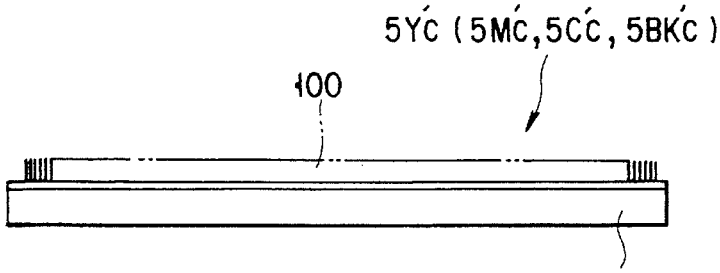
FIGS. 18A and 18B are front and side views of a transfer brush according to a modification.
Figure 18B:
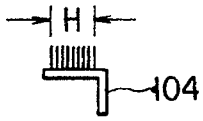

In addition, in the fourth embodiment, the brushes are not limited to those having a structure in which brush fibers 100 are maintained and clamped by an aluminum plate 102. Instead of these brushes, it is possible to use transfer brushes 5Yc', 5Mc', 5Cc', and 5BKc' which have brush fibers 100 planted in an aluminum plate 104 such that the fibers has a thickness of size H in the belt moving direction, as shown in FIGS. 18A and 18B. Further, it has been confirmed that the same effects can be obtained by other transfer members each having a number of contact points, such as electrically conductive sponge-like members made of felt or cloth, or the likes.

Further, the present invention may be variously modified without deriving from the scope of the invention.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

a plurality of image carriers sequentially arranged in parallel with each other;

a plurality of image forming means for respectively forming developer images on the image carriers;

supply means for supplying a transfer material onto which the developer images are transferred;

a conveyer belt provided so as to oppose the image carriers, for conveying the transfer material supplied from the supply means through the image carriers;

suction means provided on an upstream side of the image carriers in a conveying direction of the conveyer belt, for maintaining the supplied transfer material on the conveyer belt by a suction force; and a plurality of transfer means arranged to oppose the image carriers, respectively, with the conveyer belt being interposed between the transfer means and the image carriers, for respectively transferring the developer images formed on the image carriers to the transfer material conveyed by the conveyer belt;

wherein a conveying speed V (mm/sec) of the conveyer belt, a running distance L1 (mm) of the conveyer belt from a peeling position, at which the transfer material passes through the image carrier situated in a rearmost position on a downstream side in the conveying direction of the transfer material, to a suctioning position at which the suction means is located, a volume resistance $\rho$ ($\Omega$·cm) of the conveyer belt, and a relative dielectric constant $\epsilon$ of the conveyer belt are set so as to satisfy a relation of $$L1/V \geqq (\epsilon \cdot \epsilon_0 \cdot \rho) \times 7.$$

2. An image forming apparatus according to claim 1, wherein the suction means comprises a suction member provided in contact with the conveyer belt and having a predetermined volume resistance, and suction bias supply means for applying electric charges of the same polarity as that of the developer images to the conveyer belt.

3. An image forming apparatus according to claim 2, wherein the suction member includes a rubber roller which is in rolling contact with the conveyer belt and has a volume resistance of $10^5$ to $10^{12}$ $\Omega$·cm.

4. An image forming apparatus according to claim 1, wherein the plurality of transfer means respectively comprise corona chargers for applying a transfer bias to the transfer material, said transfer bias having a polarity opposite to a polarity of the developer images.

5. An image forming apparatus according to claim 1, wherein the plurality of image carriers include first to fourth image carriers arranged in order from a side of the supply means in the conveying direction of the transfer material, and the plurality of image forming means include first to fourth image forming means for forming developer images of yellow, magenta, cyan, and black colors on the first to fourth image carriers, respectively.

6. An image forming apparatus comprising:

a plurality of image carriers sequentially arranged in parallel with each other;

a plurality of image forming means for respectively forming developer images on the image carriers;

supply means for supplying a transfer material onto which the developer images are transferred;

a conveyer belt provided so as to oppose the image carriers, for conveying the transfer material supplied from the supply means through the image carriers; and a plurality of transfer means arranged to oppose the image carriers, respectively, with the conveyer belt being interposed between the transfer means and the image carriers, for maintaining the supplied transfer material on the conveyer belt by a suction force and for respectively transferring the developer images formed on the image carriers to the transfer material conveyed by the conveyer belt;

wherein a conveying speed V (mm/sec) of the conveyer belt, a running distance L2 (mm) of the conveyer belt from a final transfer position, at which a developer image transferred to the transfer material from the image carrier situated at a most downstream side in the conveying direction of the transfer material, to a first transfer position, at which a developer image is transferred to the transfer material from the image carrier situated at a most upstream side in the conveying direction of the transfer material, a volume resistance ρ (Ω·cm) of the conveyer belt, and a relative dielectric constant ϵ of the conveyer belt are set so as to satisfy a relation of $$L2/V \geqq (\epsilon \cdot \epsilon_0 \cdot \rho) \times 10.$$

7. An image forming apparatus according to claim 6, wherein the plurality of transfer means respectively comprise corona chargers for applying a transfer bias to the transfer material, said transfer bias having a polarity opposite to a polarity of the developer images.

8. An image forming apparatus according to claim 6, wherein the plurality of image carriers include first to fourth image carriers arranged in order from a side of the supply means in the conveying direction of the transfer material, and the plurality to image forming means include first to fourth image forming means for forming developer images of yellow, magenta, cyan, and black colors on the first to fourth image carriers, respectively.

9. An image forming apparatus comprising:

a plurality of image carriers sequentially arranged in parallel with each other;

a plurality of image forming means for respectively forming developer images on the image carriers;

supply means for supplying a transfer material onto which the developer images are transferred;

a conveyer belt provided so as to oppose the image carriers, for conveying the supplied transfer material through the image carriers; and a plurality of transfer means for maintaining the supplied transfer material on the conveyer belt by a suction force and for transferring the developer images formed on the image carriers to the transfer material, the transfer means including a plurality of transfer members provided in planar or linear contact with the conveyer belt on a side opposite to the image carriers, and bias applying means for applying a transfer bias through the transfer members to the transfer material on the conveyer belt;

wherein a conveying speed V (mm/sec) of the conveyer belt, a distance X (mm) between two adjacent image carriers, a volume resistance ρ (Ω·cm) of the conveyer belt, and a relative dielectric constant ϵ of the conveyer belt are set so as to satisfy relations as follows:

$$X/V \leqq (\epsilon \cdot \epsilon_0 \cdot \rho) \times 15$$

and $$5 \times 10^8 \leqq \rho \leqq 10^{14}.$$

10. An image forming apparatus according to claim 9, wherein the transfer members include transfer rollers provided to be in rolling contact with the conveyer belt and having a predetermined volume resistance, respectively.

11. An image forming apparatus according to claim 9, wherein the plurality of image carriers include first to fourth image carriers arranged in order from a side of the supply means in the conveying direction of the transfer material, and the plurality of image forming means include first to fourth image forming means for forming developer images of yellow, magenta, cyan, and black colors on the first to fourth image carriers, respectively.

12. An image forming apparatus comprising:

a plurality of image carriers sequentially arranged in parallel with each other;

a plurality of image forming means for respectively forming developer images on the image carriers;

supply means for supplying a transfer material onto which the developer images are transferred;

a conveyer belt provided so as to oppose the image carriers, for conveying the transfer material supplied from the supply means through the image carriers; and a plurality of transfer means for maintaining the supplied transfer material on the conveyer belt by a suction force and for transferring the developer images formed on the image carriers to the transfer material, the transfer means including a plurality of transfer members provided in contact with the conveyer belt at a number of contact points on a side of the belt opposite to the image carriers, and bias applying means for applying a transfer bias through the transfer members to the transfer material on the conveyer belt;

wherein a conveying speed V (mm/sec) of the conveyer belt, a distance X (mm) between two adjacent image carriers, a volume resistance ρ (Ω·cm) of the conveyer belt, and a relative dielectric constant ϵ of the conveyer belt are set so as to satisfy relations as follows:

$$X/V \leqq (\epsilon \cdot \epsilon_0 \cdot \rho) \times 20$$

and $$5 \times 10^9 \leqq \rho \leqq 10^{15}.$$

13. An image forming apparatus according to claim 12, wherein the transfer members include transfer brushes provided to be in rolling contact with the conveyer belt and having a predetermined volume resistance, respectively.

14. An image forming apparatus according to claim 12, wherein the plurality of image carriers include first to fourth image carriers arranged in order from side of the supply means in the conveying direction of the transfer material, and the plurality of image forming means include first to fourth image forming means for forming developer images of yellow, magenta, cyan, and black colors on the first to fourth image carriers, respectively.

* * * * *